US012686518B2

(12) United States Patent
Konstmann

(10) Patent No.: US 12,686,518 B2
(45) Date of Patent: Jul. 21, 2026

(54) STRETCH-HOOD MACHINE FOR PARTIALLY SEALED STRETCH-HOOD

(71) Applicant: Signode Industrial Group LLC, Tampa, FL (US)

(72) Inventor: Tonny Konstmann, Nordborg (DK)

(73) Assignee: Signode Industrial Group LLC, Tampa, FL (US)

( * ) Notice: Subject to any disclaimer, the term of this patent is extended or adjusted under 35 U.S.C. 154(b) by 0 days.

(21) Appl. No.: 19/120,530

(22) PCT Filed: Oct. 13, 2023

(86) PCT No.: PCT/US2023/035160

§ 371 (c)(1),
(2) Date: Apr. 11, 2025

(87) PCT Pub. No.: WO2024/081431

PCT Pub. Date: Apr. 18, 2024

(65) Prior Publication Data

US 2026/0109503 A1 Apr. 23, 2026

Related U.S. Application Data

(60) Provisional application No. 63/416,335, filed on Oct. 14, 2022.

(51) Int. Cl.
*B65B 9/14* (2006.01)
*B65B 9/13* (2006.01)
(Continued)

(52) U.S. Cl.
CPC ..... *B65B 51/14* (2013.01); *B65B 9/135* (2013.01); *B65B 9/14* (2013.01); *B65B 51/303* (2013.01)

(58) Field of Classification Search
None
See application file for complete search history.

(56) References Cited

U.S. PATENT DOCUMENTS 4,064,678 A * 12/1977 Grocke ..... B65B 9/135 53/567
6,298,636 B1 * 10/2001 Lachenmeier ..... B65B 9/135 53/442

(Continued)

FOREIGN PATENT DOCUMENTS

CN 109070560 B 11/2020
EP 0 579 858 B1 6/1997

(Continued)

OTHER PUBLICATIONS

Phoenix Wrappers, "Wrapping Product that Needs to Breathe" Sep. 27, 2021, https://phoenixwrappers.com/wrapping-product-that-needs-to-breathe-during-transport/.

(Continued)

*Primary Examiner* — Tanzim Imam
(74) *Attorney, Agent, or Firm* — McDonnell Boehnen Hulbert & Berghoff LLP

(57) ABSTRACT

Various embodiments of the present disclosure provide a stretch-hood machine and method of operating a stretch-hood machine to wrap an item with tubular film. The method includes drawing tubular film from a roll of film and forming a first seal section at a first end of a section of the tubular film, where the first seal section extends across only a portion of a width of the tubular film so as to provide a partial seal with a first opening at the first end of the section of tubular film. Using reefing devices, the tubular film is lowered around the item to wrap the item within an interior of the tubular film. The first opening at the first end of the (Continued)

section of tubular film provides access between the interior of the tubular film and the exterior environment.

20 Claims, 14 Drawing Sheets

(51) Int. Cl.
*B65B 51/14* (2006.01)
*B65B 51/30* (2006.01)

(56) References Cited

U.S. PATENT DOCUMENTS

| | | | | |
|---|---|---|---|---|
| 7,320,403 | B2 | 1/2008 | May, Jr. | |
| 10,894,644 | B2 | 1/2021 | Christensen | |
| 11,059,614 | B2 | 7/2021 | Granger et al. | |
| 11,097,860 | B2 | 8/2021 | Lorenzen et al. | |
| 2016/0221703 | A1* | 8/2016 | Fenn | B65B 65/02 |
| 2018/0044043 | A1* | 2/2018 | Frenzel | B65B 41/12 |
| 2019/0152632 | A1* | 5/2019 | Lorenzen | B65B 9/135 |
| 2021/0188467 | A1* | 6/2021 | Bocedi | B65B 51/10 |
| 2021/0354861 | A1 | 11/2021 | Konstmann | |
| 2022/0332450 | A1* | 10/2022 | Mun | B65B 43/465 |
| 2023/0182939 | A1* | 6/2023 | Olsen | B65B 9/10 53/567 |

FOREIGN PATENT DOCUMENTS

| | | | |
|---|---|---|---|
| EP | 0 344 815 | B2 | 10/1997 |
| EP | 0 399 540 | B2 | 7/2000 |
| EP | 1 721 830 | B1 | 7/2008 |
| EP | 2 921 415 | A1 | 9/2015 |
| KR | 10 2022 0014419 | A | 2/2022 |
| WO | 2018/009629 | A1 | 1/2018 |
| WO | 2021/058850 | A1 | 4/2021 |

OTHER PUBLICATIONS

International Search Report and Written Opinion prepared by the European Patent Office in International Application No. PCT/US2023/035160 dated May 14, 2024.

* cited by examiner

STRETCH-HOOD MACHINE FOR PARTIALLY SEALED STRETCH-HOOD

PRIORITY

This application is a national application under 35 U.S.C. § 371 of International Patent Application No. PCT/US2023/035160, filed Oct. 13, 2023, which claims priority to and the benefit of U.S. Provisional Application No. 63/416,335 filed Oct. 14, 2022, the entire contents of each of which are hereby incorporated by reference.

FIELD

The present disclosure relates to stretch-hood machines for wrapping loads of goods with tubular stretch film, and more particularly to stretch-hood machines configured to wrap loads of goods with tubular film that is partially sealed.

BACKGROUND

Stretch-hood machines wrap loads of goods with tubular plastic stretch film. These stretch-hood machines include a frame that supports a film-supply assembly, a film-opening assembly, and a reefing-and-wrapping assembly. The reefing-and-wrapping assembly includes a wrapping carriage that supports four reefing devices. Each reefing device includes a support that supports a drive roller and a vertically extending reefing finger. A motor drives the drive roller, and the reefing finger supports a freely rotatable guide roller. The drive roller is movable toward and away from the guide roller.

To wrap a load of goods, the film-supply assembly draws the tubular film from a film roll, cuts the film to a desired length to form a section of tubular film, and in certain instances heat seals the top of the section of tubular film completely closed. The film-opening assembly opens the bottom portion of the section of tubular film so its perimeter is generally rectangular. Each reefing device moves laterally inwardly relative to the section of tubular film to respective insertion positions in which they form an insertion configuration. The wrapping carriage then ascends relative to the section of tubular film until the reefing fingers of the reefing devices enter the open bottom portion of the section of tubular film near its four corners. The reefing devices then move laterally outwardly to respective reefing positions in which they form a reefing configuration in preparation for reefing the section of tubular film onto the reefing fingers. The drive rollers of the reefing devices move toward their respective guide rollers to engage the outer surface of the section of tubular film and force the inner surface of the section of tubular film against the guide rollers, thereby sandwiching the tubular film between the rollers. The motors drive their respective drive rollers in a reefing rotational direction to reef (or gather) the section of tubular film onto the reefing fingers.

After reefing, the reefing devices each move laterally outwardly into respective wrapping positions in which they form a wrapping configuration. Because the film is elastic, it stretches during this movement. The wrapping configuration is (and therefore the wrapping positions are) determined based on the size and shape of the load so the perimeter of the section of tubular film is sized to circumscribe the load once the reefing devices reach the wrapping configuration. After the reefing devices reach the wrapping configuration, the wrapping carriage descends relative to the load. During this descent the motors drive the drive rollers of the reefing devices in an unreefing rotational direction opposite the reefing rotational direction at an unreefing speed to unreef the remainder of the film from the reefing fingers. As this occurs, the film attempts to return to its unstretched size and shape and laterally retracts onto the load, which unitizes the load and/or secures the load to a pallet. This completes the wrapping process, and a conveyor conveys the load from the stretch-hood machine.

In some instances, it is desirable to provide ventilation for the load, for example to avoid moisture related problems. One possible way to provide ventilation is to leave the upper end of the tubular film completely unsealed. This provides access between the interior of the tubular film and the surrounding environment, which reduces the likelihood of unwanted moisture buildup. However, certain loads are not compatible with such a wrapping configuration. For example, loads that have a varying width or unusual shape may not be secured properly if the top of the tubular film is left open.

SUMMARY

Various embodiments of the present disclosure provide methods and stretch-hood machines for wrapping an item with a section of tubular film that includes a partial seal along its upper end.

In one embodiment, a method of operating a stretch-hood machine to wrap an item with a section of tubular film comprises drawing tubular film from a roll of film and forming a first seal section at a first end of a section of the tubular film. The first seal section extends across only a portion of a width of the tubular film so as to provide a partial seal with a first opening at the first end of the section of tubular film. The method also includes positioning the segment of tubular film on a plurality of reefing devices and reefing the segment of tubular film onto reefing fingers of the reefing devices. Further, the method includes lowering the reefing devices around the item to wrap the item within an interior of the tubular film. The first opening at the first end of the section of tubular film provides access between the interior of the tubular film and the exterior environment.

In one embodiment, a stretch-hood machine comprises a machine frame, a wrapping carriage movable relative to the machine frame between upper and lower positions, and a plurality of reefing devices supported by the wrapping-carriage and configured to wrap tubular film around an item. A film-supply assembly is configured to direct a section of the tubular film to the reefing devices from a roll of tubular film having a first width. The machine also includes a sealing system including first and second sealing unit strips that extend along a first line and are spaced apart along the first line by a gap and are configured to provide a partial seal with an opening corresponding to the gap between the first and second sealing unit strips.

In one embodiment, a stretch-hood machine comprises a machine frame, a wrapping carriage movable relative to the machine frame between upper and lower positions, and a plurality of reefing devices supported by the wrapping-carriage and configured to wrap tubular film around an item. A film-supply assembly is configured to direct a section of the tubular film to the reefing devices from a roll of tubular film having a first width. The stretch-hood machine further includes a sealing system comprising a first sealing unit strip having a length that is smaller than the first width of the roll of tubular film and configured to form a first seal section at a first end of the section of tubular film that extends across only a portion of the width of the tubular film so as to provide a partial seal with a first opening at the first end of the section of tubular film.

DETAILED DESCRIPTION

Figure 1:
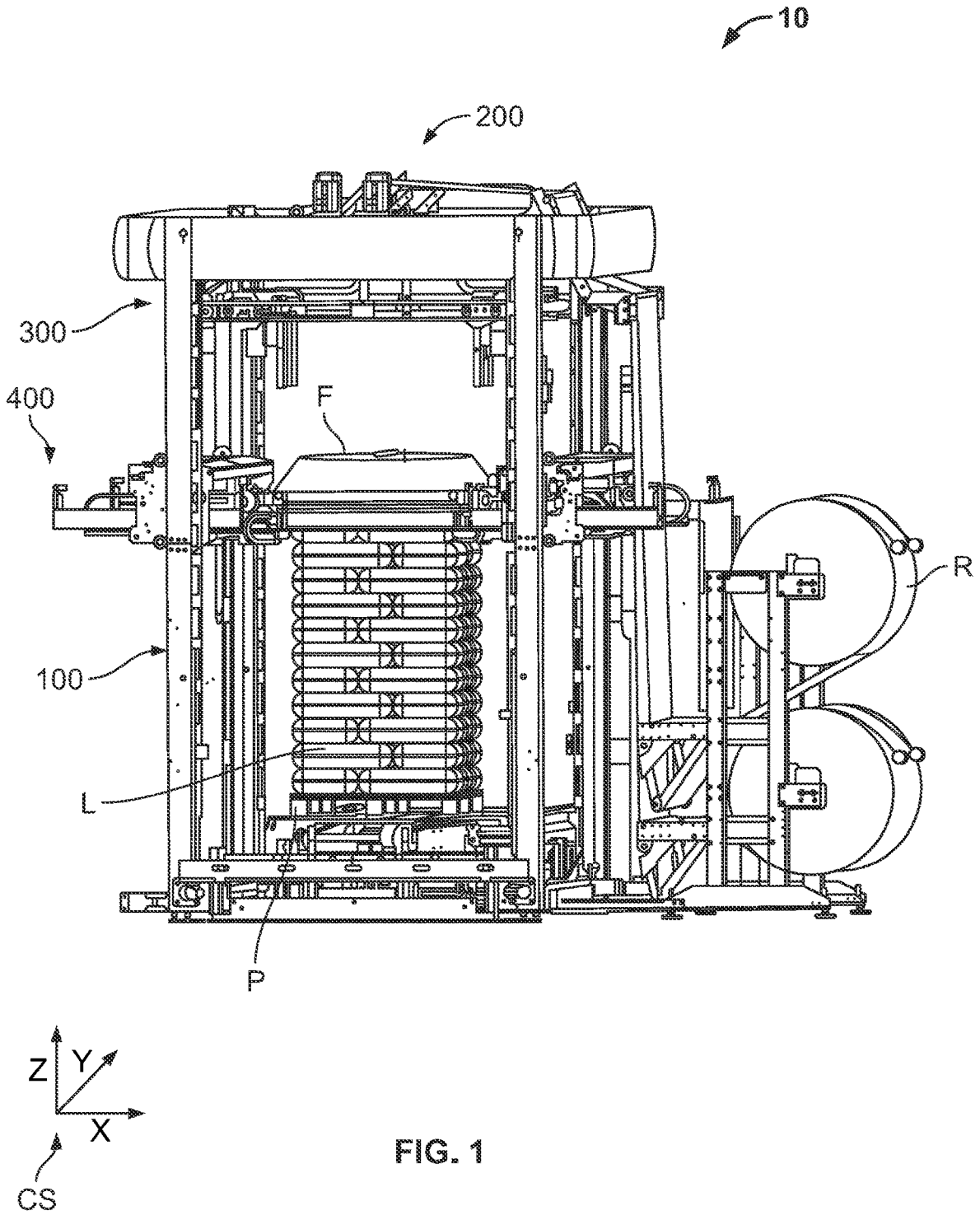
FIG. 1 is a perspective view of one embodiment of the stretch-hood machine of the present disclosure.
Figure 2:
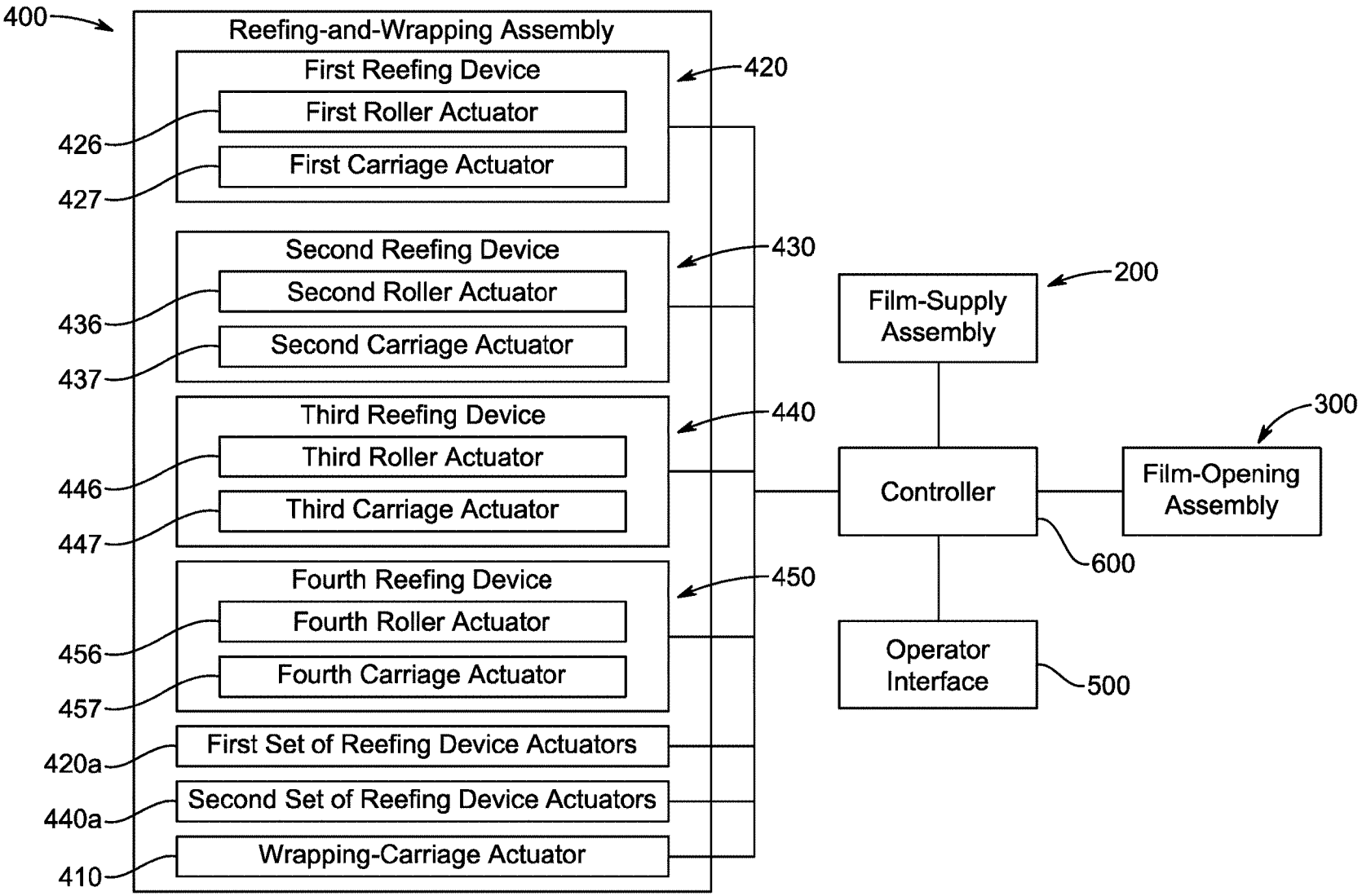
FIG. 2 is a block diagram showing certain components of the stretch-hood machine of FIG. 1.

Various embodiments of the present disclosure provide a stretch-hood machine configured to wrap loads of goods with a section of tubular film that includes a partial seal along its upper end. FIGS. 1-10, 12 and 13 show one embodiment of the stretch-hood machine 10 of the present disclosure and the assemblies and components of the stretch-hood machine 10. The stretch-hood machine 10 includes a machine frame 100, a film-supply assembly 200 supported by the machine frame 100, a film-opening assembly 300 supported by the machine frame 100, a reefing-and-wrapping assembly 400 supported by the machine frame 100, an operator interface 500, and a controller 600. A coordinate system CS (shown in FIG. 1) is used herein as a frame of reference for directional movement of various components of the stretch-hood machine 10 in the X-, Y-, and Z-directions (which are perpendicular to one another in this example embodiment).

The machine frame 100 is formed from multiple tubular and/or solid members and other elements (not individually labeled) and is configured to support the other assemblies and components of the stretch-hood machine 10. The machine frame 100 defines a wrapping area within its interior and has an infeed area (not labeled) at which a palletized load (such as a load L on a pallet P) is conveyed into the wrapping area for wrapping and an outfeed area (not labeled) at which the palletized load is conveyed from the wrapping area after wrapping. The illustrated machine frame 100 is merely one example configuration, and any suitable configuration may be employed.

The film-supply assembly 200 includes suitable components configured to form a section of tubular film F that the stretch-hood machine 10 then uses to wrap the load L. More specifically, and as is known in the art, the film-supply assembly 200 includes components suitable to draw a length of tubular film from a roll R of tubular film rotatably mounted to the machine frame 100, cut the length of tubular film from the roll R to form the section of tubular film F, and, optionally, close at least a portion of the upper end of the section of tubular film, as described in more detail below. When wrapping a load L, the controller 600 determines the length of the section of tubular film F based (in part) on the height of the load L, as is known in the art.

The film-opening assembly 300 includes suitable components configured to open a bottom portion of the section of tubular film F so it forms a generally rectangular perimeter in preparation for reefing by the reefing-and-wrapping assembly 400. More specifically, and as is known in the art, the film-opening assembly 300 includes four suction boxes and four corresponding holding devices (not labeled) that are movable laterally inward and outward in the X- and Y-directions and generally parallel to the X-Y plane relative to the section of tubular film F. To open the bottom portion of the section of tubular film F, the suction boxes move laterally inward in the X- and Y-directions so they are positioned adjacent the outer surface of the bottom portion of the section of tubular film F. A vacuum is generated to draw the bottom portion of the section of tubular film F onto the suction boxes, thereby partially opening the bottom portion. The holding devices then clamp the section of tubular film, and the suction boxes and holding devices move laterally outward in the X- and Y-directions and generally parallel to the X-Y plane to open the bottom portion of the section of tubular film F in preparation for reefing. At this point, the perimeter of the bottom portion of the section of tubular film F forms a generally rectangular shape in preparation for reefing. This is merely one example of the film-opening assembly 300, and other embodiments of the film-opening assembly 300 may include any other suitable components.

The reefing-and-wrapping assembly 400 includes a wrapping carriage (not shown for clarity); a wrapping-carriage actuator 410; first, second, third, and fourth reefing devices 420, 430, 440, and 450; and first and second sets of reefing-device actuators **420*a* and 440*a*. The wrapping carriage includes a suitable frame and is vertically movable relative to the machine frame 100 in the Z-direction between upper and lower positions. The wrapping-carriage actuator 410**, which may include any suitable actuator (such as an electric or a hydraulic motor), is operably connected to the wrapping carriage to move the wrapping carriage between its upper and lower positions.

Figure 3:
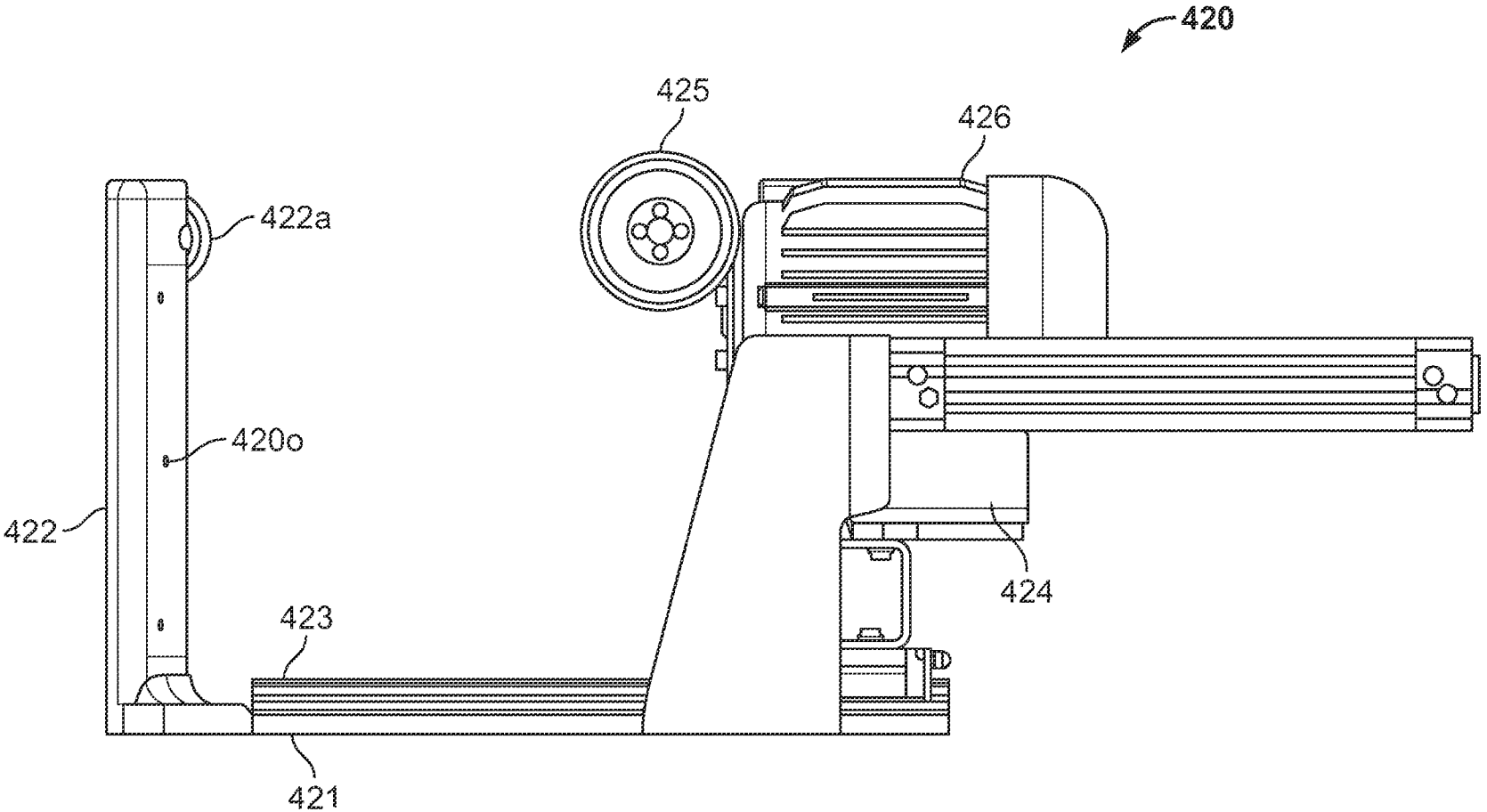
FIG. 3 is a side elevational view of one of the reefing devices of the stretch-hood machine of FIG. 1 with the reefing carriage in its home position.
Figure 8:
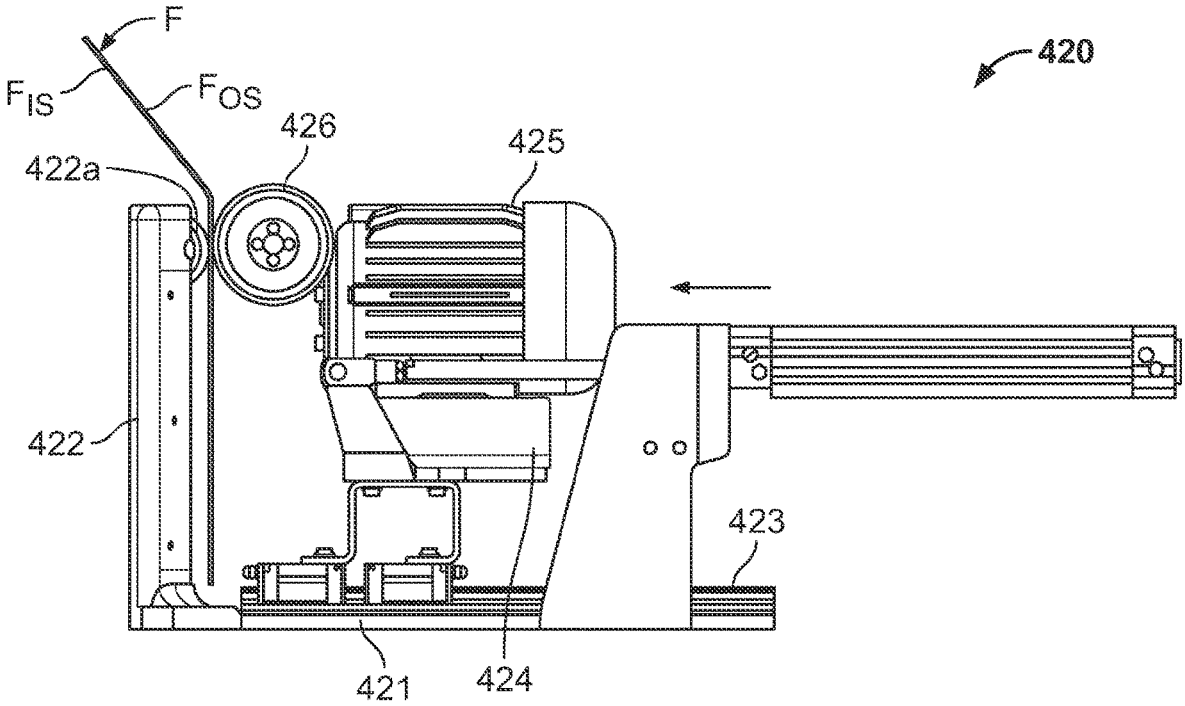
FIG. 8 is a side elevational view of the reefing device of FIG. 3 that corresponds to FIG. 6.
Figure 10:
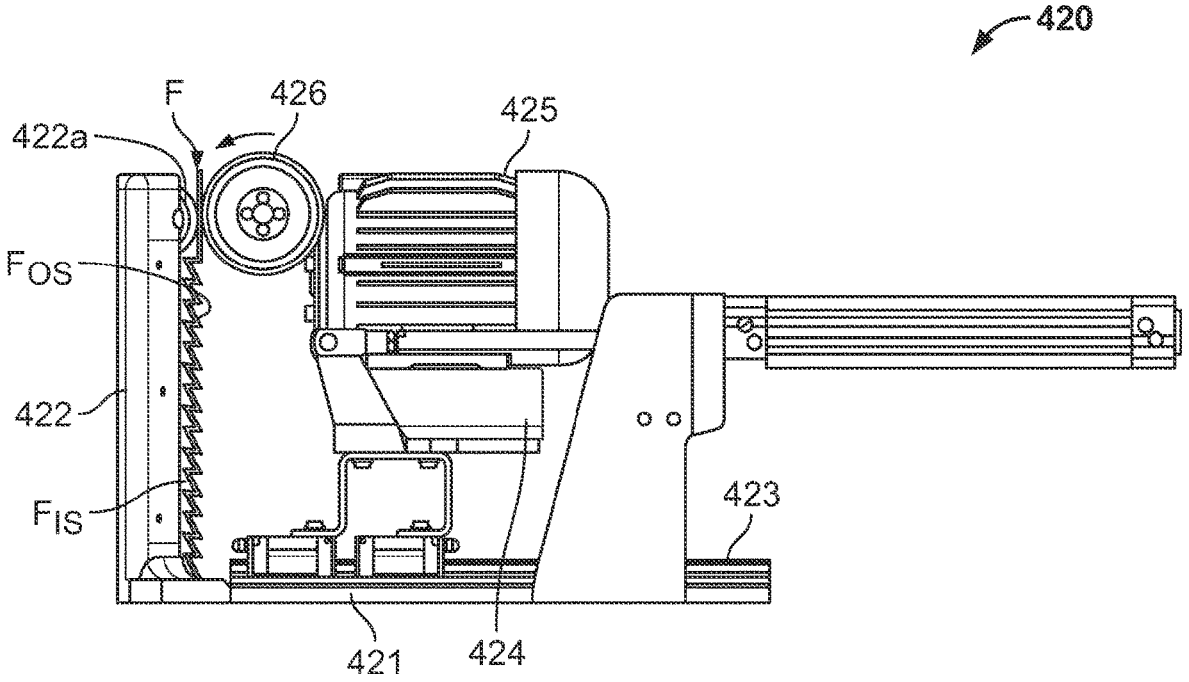
FIG. 10 is a side elevational view of the reefing device of FIG. 3 that corresponds to FIG. 9.

FIGS. 3, 8, and 10 show the first reefing device 420, which includes a first support 421, a first reefing finger 422 extending generally vertically in the Z-direction from one end of the first support 421, a freely rotatable first guide roller 422*a* mounted to the first reefing finger 422, a first rail 423 supported by the first support 421, a first carriage 424 mounted to the first rail 423 and configured to move along the first rail 423 between a home position spaced-apart from the first guide roller 422*a* (FIG. 3) and a reefing position adjacent the first guide roller 422*a* (FIGS. 8 and 10), a first drive roller 425 supported by the first carriage 424, a first roller actuator 426 supported by the first carriage 424 and operably connected to the first drive roller 425 to rotate the first drive roller 425 in opposing reefing and unreefing rotational directions, and a first carriage actuator 427 operably connected to the carriage 424 to move the carriage 424 between its home and reefing positions.

The second reefing device 430 is similar to the first reefing device 420 and not shown separately. The second reefing device includes a second support 431, a second reefing finger 432 extending generally vertically from one end of the second support 431, a freely rotatable second guide roller 432*a* mounted to the second reefing finger 432, a second rail 433 supported by the second support 431, a second carriage 434 mounted to the second rail 433 and configured to move along the second rail 433 between a home position spaced-apart from the second guide roller 432*a* and a reefing position adjacent the second guide roller 432*a*, a second drive roller 435 supported by the second carriage 434, a second roller actuator 436 supported by the second carriage 434 and operably connected to the second drive roller 435 to rotate the second drive roller 435 in opposing reefing and unreefing rotational directions, and a second carriage actuator 437 operably connected to the carriage 434 to move the carriage 434 between its home and reefing positions.

The third reefing device 440 is similar to the first reefing device 420 and not shown separately. The third reefing device includes a third support 441, a third reefing finger 442 extending generally vertically from one end of the third support 441, a freely rotatable third guide roller 442*a* mounted to the third reefing finger 442, a third rail 443 supported by the third support 441, a third carriage 444 mounted to the third rail 443 and configured to move along the third rail 443 between a home position spaced-apart from the third guide roller 442*a* and a reefing position adjacent the third guide roller 442*a*, a third drive roller 445 supported by the third carriage 444, a third roller actuator 446 supported by the third carriage 444 and operably connected to the third drive roller 445 to rotate the third drive roller 445 in opposing reefing and unreefing rotational directions, and a third carriage actuator 447 operably connected to the carriage 444 to move the carriage 444 between its home and reefing positions.

The fourth reefing device 450 is similar to the first reefing device 420 and not shown separately. The fourth reefing device includes a fourth support 451, a fourth reefing finger 452 extending generally vertically from one end of the fourth support 451, a freely rotatable fourth guide roller 452*a* mounted to the fourth reefing finger 452, a fourth rail 453 supported by the fourth support 451, a fourth carriage 454 mounted to the fourth rail 453 and configured to move along the fourth rail 453 between a home position spaced-apart from the fourth guide roller 452*a* and a reefing position adjacent the fourth guide roller 452*a*, a fourth drive roller 455 supported by the fourth carriage 454, a fourth roller actuator 456 supported by the fourth carriage 454 and operably connected to the fourth drive roller 455 to rotate the fourth drive roller 455 in opposing reefing and unreefing rotational directions, and a fourth carriage actuator 457 operably connected to the carriage 454 to move the carriage 454 between its home and reefing positions.

The first, second, third, and fourth reefing devices 420, 430, 440, and 450 are mounted to the frame of the wrapping carriage in a generally rectangular arrangement. The first set of reefing-device actuators 420*a* is operably connected to the first and second reefing devices 420 and 430 to move the first and second reefing devices 420 and 430 laterally inwardly and outwardly in the X- and Y-directions and generally parallel to the X-Y plane relative to the wrapping carriage (and the load L and the section of tubular film F). The second set of reefing-device actuators 440*a* is operably connected to the third and fourth reefing devices 440 and 450 to move the third and fourth reefing devices 440 and 450 laterally inwardly and outwardly in the X- and Y-directions and generally parallel to the X-Y plane relative to the wrapping carriage (and the load L and the section of tubular film F).

The first set of reefing-device actuators 420*a* includes a first X-actuator and a first Y-actuator that are controlled independently of one another. The first X-actuator is operably connected to the first and second reefing devices 420 and 430 and configured to move the first and second reefing devices 420 and 430 relative to the wrapping carriage in the X-direction. The first Y-actuator is operably connected to the first and second reefing devices 420 and 430 and configured to move the first and second reefing devices 420 and 430 relative to the wrapping carriage in the Y-direction. In this example embodiment, the first X- and Y-actuators include electric motors controlled by separate variable-frequency drives, but the actuators may be any suitable actuators in other embodiments (such as hydraulic motors controlled by proportional solenoid valves). In this example embodiment, the first X-actuator moves the first and second reefing devices simultaneously and at the same rate towards and away from the load in the X-direction. Similarly, the first Y-actuator moves the first and second reefing devices simultaneously and at the same rate towards and away from the load in the Y-direction.

The second set of reefing-device actuators 440*a* includes a second X-actuator and a second Y-actuator that are controlled independently of one another. The second X-actuator is operably connected to the third and fourth reefing devices 440 and 450 and configured to move the third and fourth reefing devices 440 and 450 relative to the wrapping carriage in the X-direction. The second Y-actuator is operably connected to the third and fourth reefing devices 440 and 450 and configured to move the third and fourth reefing devices 440 and 450 relative to the wrapping carriage in the Y-direction. In this example embodiment, the second X- and Y-actuators include electric motors controlled by separate variable-frequency drives, but the actuators may be any suitable actuators in other embodiments (such as hydraulic motors controlled by proportional solenoid valves). In this example embodiment, the second X-actuator moves the third and fourth reefing devices simultaneously and at the same rate towards and away from the load in the X-direction. Similarly, the second Y-actuator moves the third and fourth reefing devices simultaneously and at the same rate towards and away from the load in the Y-direction.

In other embodiments, the stretch-hood machine includes a separate set of one or more reefing device actuators for each individual reefing device. In some of these embodiments, each set of reefing device actuators includes independently controlled X- and Y-actuators similar to those described above.

The operator interface 500 is configured to receive inputs from an operator and, in certain embodiments, to output information to the operator. The operator interface includes one or more input devices configured to receive inputs from the operator. In various embodiments, the one or more input devices include one or more buttons (such as hard or soft keys), one or more switches, and/or a touch panel. In various embodiments, the operator interface 500 includes a display device configured to display information to the operator, such as information about the palletized load, the status of the wrapping operation, or the settings of the stretch-hood machine 10. The operator interface may include other output devices instead of or in addition to the display device, such as one or more speakers and/or one or more lights. In certain embodiments, the operator interface 500 is formed as part of the stretch-hood machine 10 and is, for instance, mounted to the machine frame 100. In other embodiments, the operator interface is remote from the stretch-hood machine 10.

The controller 600 includes a processing device communicatively connected to a memory device. The processing device may include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the stretch-hood machine 10.

The controller 600 is communicatively and operably connected to the film-supply assembly 200 and any film sealing systems included therein (e.g., film sealing system 220, as described further below); the film-opening assembly 300; the wrapping-carriage actuator 410; the first and second sets of reefing-device actuators 420*a* and 440*a*; and the first, second, third, and fourth sets of roller actuators 426, 436, 446, and 456; the first, second, third, and fourth carriage actuators 427, 437, 447, and 457. The controller 600 is communicatively connected to the operator interface 500 to: (1) receive signals from the operator interface 500 that represent inputs received by the operator interface 500; and (2) send signals to the operator interface 500 to cause the operator interface 500 to output (such as to display) information.

Upon initiation of a wrapping process, a section of tubular film is created. In this example embodiment, the controller 600 controls the film-supply assembly 200 to draw tubular film from the film roll R, optionally forming a complete or partial seal along an upper end of a section of the tubular film, and cut the film to a desired length (which depends on the height of the load) to form the section of tubular film F. The bottom portion of the section of tubular film is then opened. In this example embodiment, the controller 600 controls the film-opening assembly 300 (and more particularly, the suction boxes and holding devices) to open the bottom portion of the section of tubular film F so the shape of its perimeter is generally rectangular, as explained above.

Figure 4:
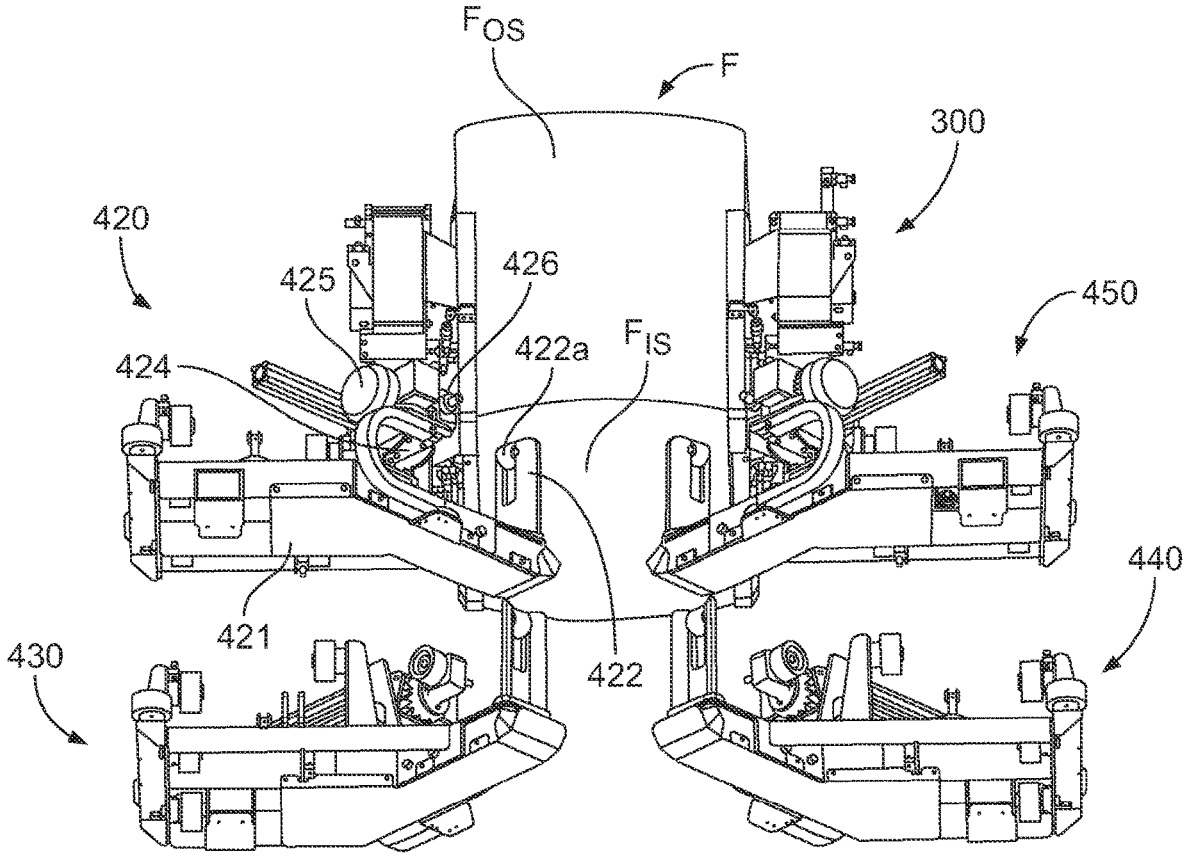
FIG. 4 is a perspective view of the film-opening device and the reefing devices of the stretch-hood machine of FIG. 1 after the film-opening device has opened the bottom of a section of tubular film and before the reefing fingers of the reefing devices have been inserted into the bottom of the section of tubular film.
Figure 5:
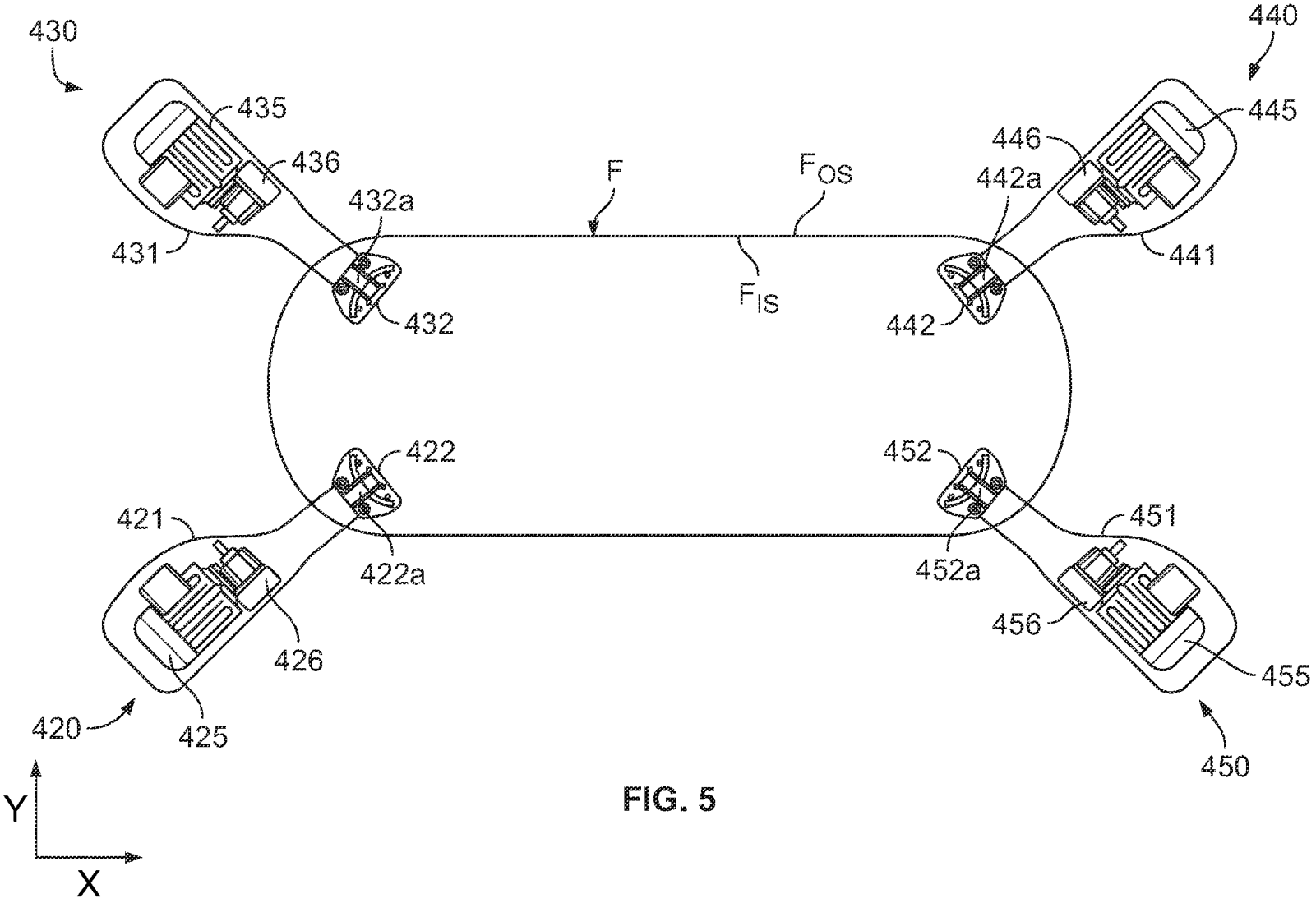
FIG. 5 is a simplified top plan view that corresponds to FIG. 4.

The reefing devices are then moved to their insertion positions. In this example embodiment, the controller 600 controls the first and second sets of reefing-device actuators 420*a* and 440*a* to move the respective reefing devices 420, 430, 440, and 450 laterally inwardly relative to the section of tubular film F (in the X- and Y-directions and generally parallel to the X-Y plane) to their respective insertion positions in which they form an insertion configuration. FIGS. 4 and 5 show the reefing devices 420, 430, 440, and 450 at their insertion positions. The insertion positions are preset (such as by the operator) based on several factors, including the size of the film (e.g., its unstretched perimeter). At this point, and as shown in FIG. 3 for the reefing device 420, the first, second, third, and fourth carriages 424, 434, 444, and 454 of the first, second, third, and fourth reefing devices 420, 430, 440, and 450 are in their respective home positions. The wrapping carriage is then raised so the reefing fingers of the reefing devices are received in the open bottom portion of the section of tubular film. In this example embodiment, the controller 600 controls the wrapping-carriage actuator 410 to raise the wrapping carriage so the reefing fingers 422, 432, 442, and 452 of the respective reefing devices 420, 430, 440, and 450 are received in the open bottom portion of the section of tubular film F.

Figure 6:
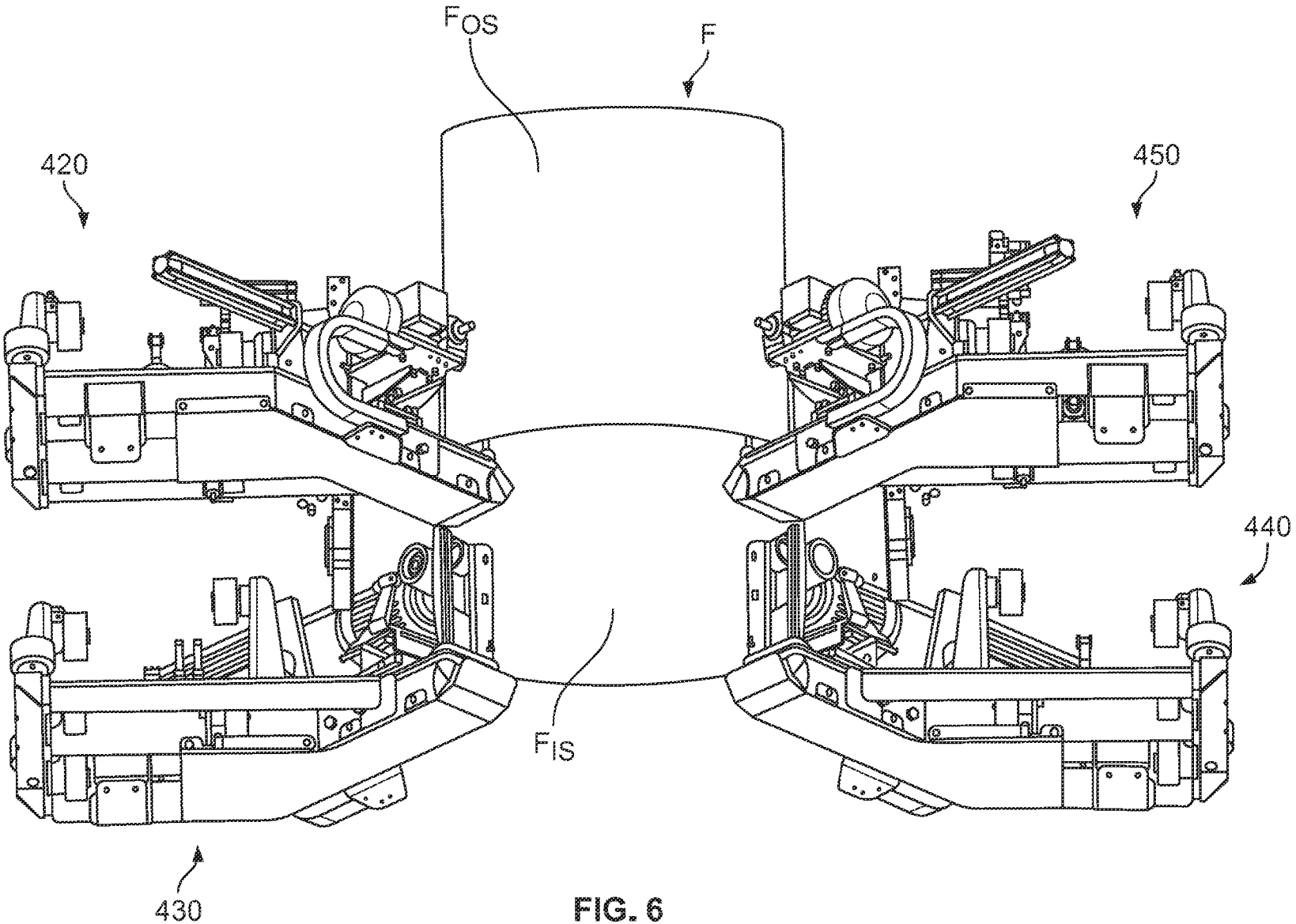
FIG. 6 is a perspective view similar to FIG. 4 but after the reefing fingers of the reefing devices have been inserted into the bottom of the section of tubular film and after the reefing carriages of the reefing devices have moved to their respective reefing positions.
Figure 7:
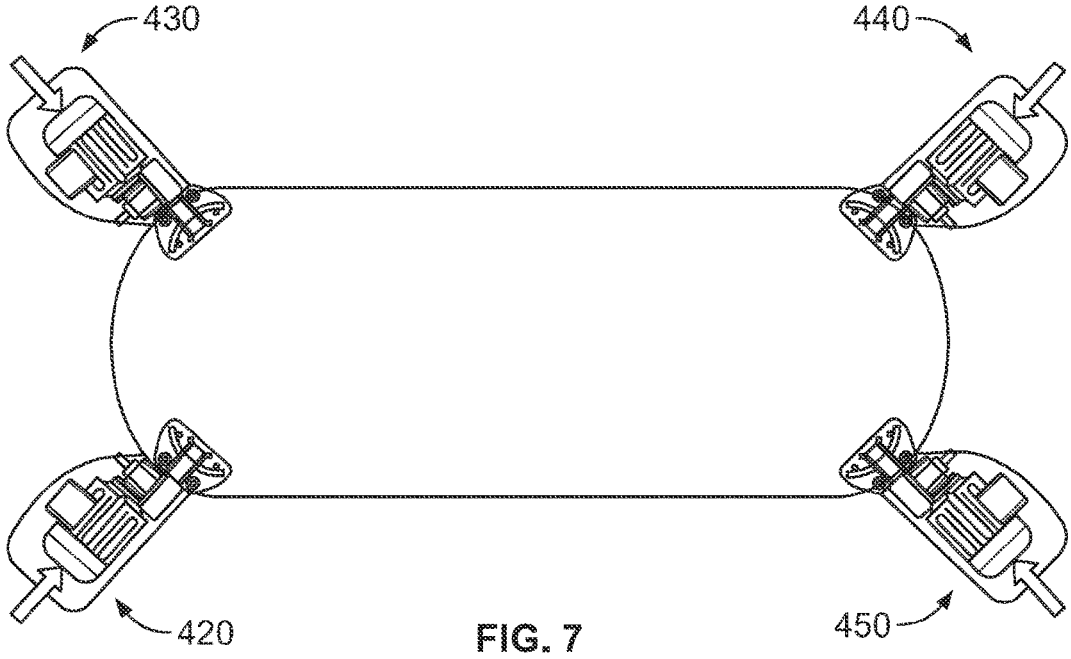
FIG. 7 is a simplified top plan view that corresponds to FIG. 6.
Figure 9:
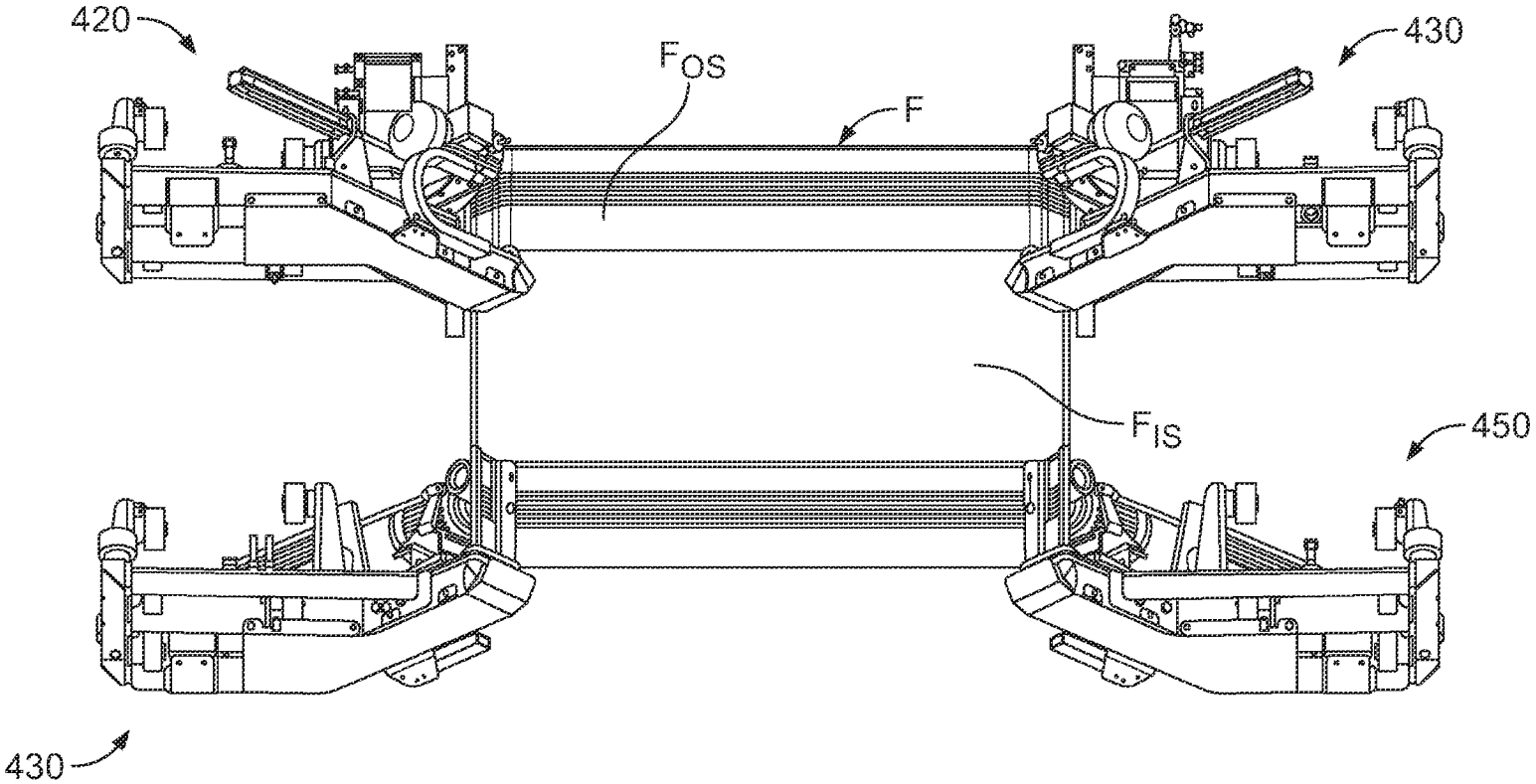
FIG. 9 is a perspective view similar to FIG. 6 but after the reefing devices have reefed the section of tubular film onto their reefing fingers.

The reefing devices are then moved to their reefing positions, and the reefing devices reef the section of tubular film onto the reefing fingers. In this example embodiment, the controller 600 controls the first and second sets of reefing-device actuators 420*a* and 440*a* to move the respective reefing devices 420, 430, 440, and 450 laterally outwardly relative to the section of tubular film F (in the X- and Y-directions and generally parallel to the X-Y plane) to their respective reefing positions in which they form a reefing configuration in preparation for reefing the section of tubular film F. The controller 600 then controls the first, second, third, and fourth carriage actuators 427, 437, 447, and 457 to move the respective carriages 424, 434, 444, and 454 from their respective home positions to their respective reefing positions, which causes the drive wheels 425, 435, 445, and 455 of the reefing devices 420, 430, 440, and 450 to contact the inner surface Fis of the section of tubular film F and force the outer surface Fos of the section of tubular film F against the respective guide wheels 422*a*, 432*a*, 442*a*, and 452*a*. FIGS. 6-8 show the reefing devices 420, 430, 440, and 450 in their reefing positions after their carriages have moved to their respective reefing positions. In certain embodiments, the carriages move to their reefing positions as the reefing devices move to their reefing positions. The controller 600 then controls the first, second, third, and fourth roller actuators 426, 436, 446, and 456 to drive the first, second, third, and fourth drive rollers 425, 435, 445, and 455 in a reefing rotational direction to reef the section of tubular film F onto the reefing fingers 422, 432, 442, and 452. FIGS. 9 and 10 show the reefing devices 420, 430, 440, and 450 after reefing.

The reefing devices then begin moving toward respective wrapping positions so as to form a wrapping configuration. In this example embodiment, the controller 600 controls the first and second sets of reefing-device actuators 420*a* and 440*a* to begin moving the respective reefing devices 420, 430, 440, and 450 from their respective reefing positions to their respective wrapping positions, causing the section of tubular film to stretch. Here, the wrapping positions of the respective reefing devices are located laterally outward (in the X- and Y-directions and generally parallel to the X-Y plane) relative to the reefing positions. Additionally, the reefing devices each follow a 45-degree path within the X-Y plane as they move from their respective reefing positions to their respective wrapping positions (though the movement path and resulting angle may differ in other embodiments).

After the reefing devices reach the wrapping configuration, the wrapping carriage descends relative to the load (in the Z-direction indicated in FIG. 1). During this descent the motors drive the drive rollers of the reefing devices in the unreefing rotational direction at an unreefing speed to unreef the remainder of the film from the reefing fingers. As this occurs, the film attempts to return to its unstretched size and shape and laterally contracts onto the load, which unitizes the load and/or secures the load to a pallet. This completes the wrapping process, and a conveyor conveys the load from the stretch-hood machine.

Figure 11:
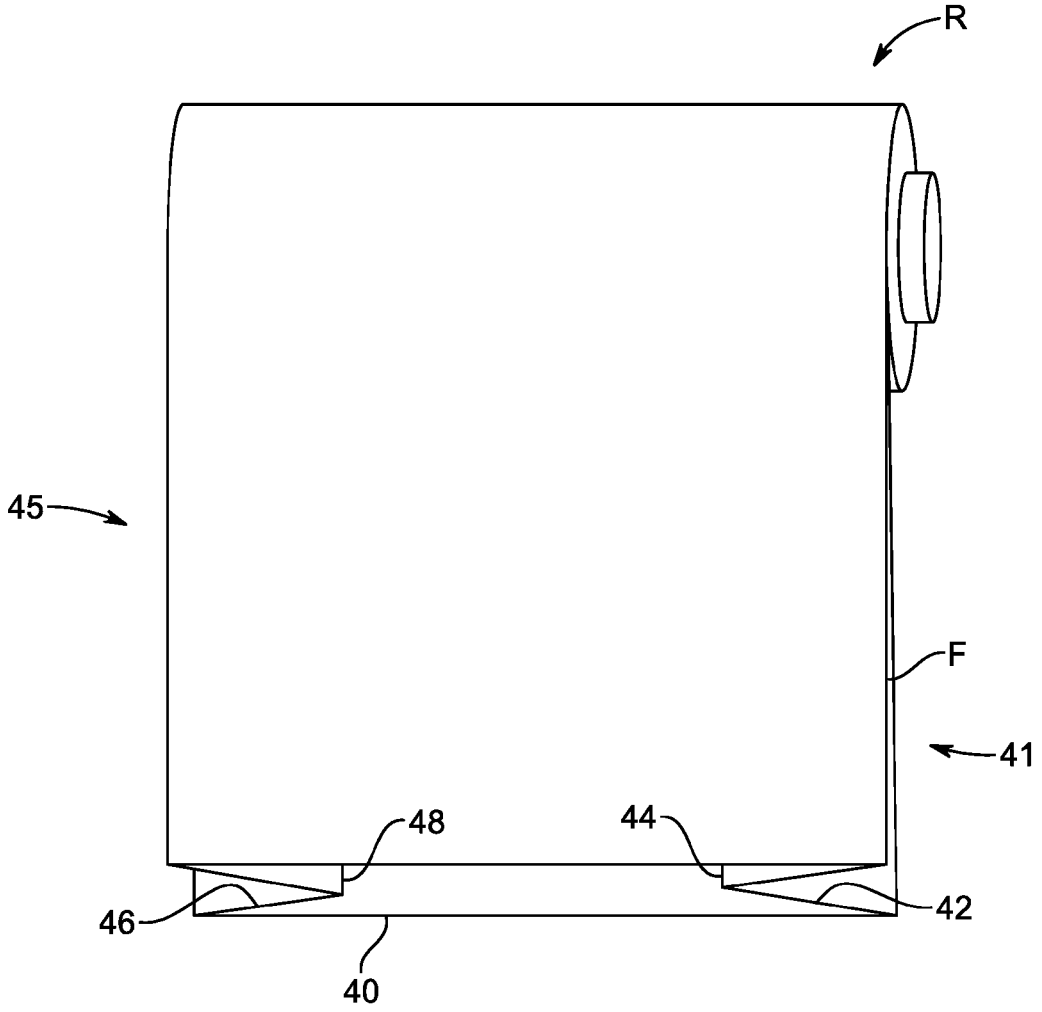
FIG. 11 is a perspective view of a roll of tubular film.
Figure 12:
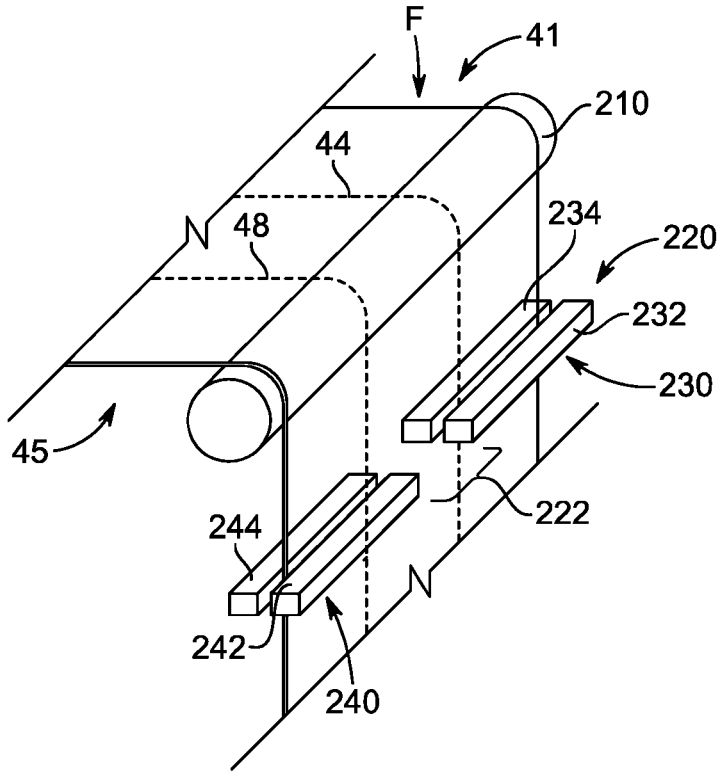
FIG. 12 is a schematic perspective view of a sealing unit in a first position.
Figure 13:
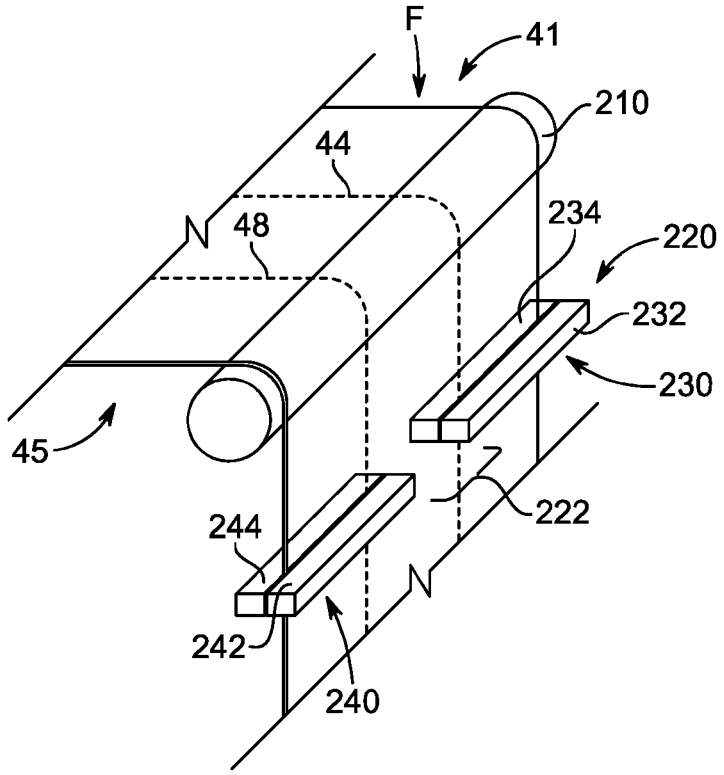
FIG. 13 is a schematic perspective view of the sealing unit of FIG. 12 in a second position.
Figure 14:
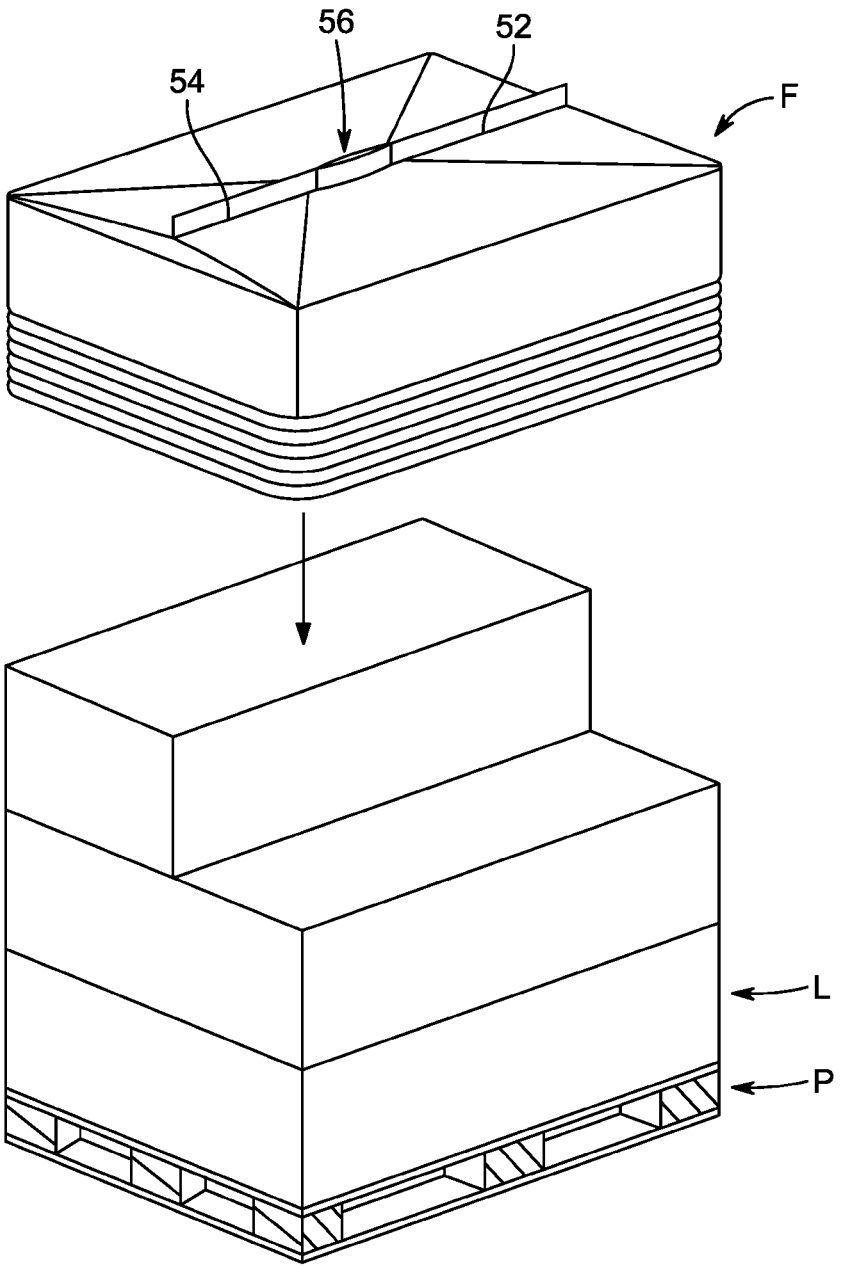
FIG. 14 is a schematic depiction showing a stretch-hood that is expanded to be placed over an item.

FIGS. 12-14 illustrate one example embodiment of the use of a sealing system 220 for forming a partial seal at the upper end of a section of tubular film for wrapping an item that includes a pallet P and load L. The roll of tubular film R used in this example embodiment is shown in FIG. 11. As shown, the film F provided on the roll R has a tubular form with an opening 40 at a free end of the film F that provides access to the interior of the tubular film F. The tubular film F is drawn off the roll as a flat sheet having a width that extends from an edge that runs along a first side 41 of the sheet to an edge that runs along the second side 45 of the sheet. Along each side of the sheet of tubular film F, part of the film is folded to form a gusset. For example, as shown in FIG. 11, a first gusset 42 is formed along the first side 41 and extends inward toward the center of the sheet of tubular film to a folded edge 44. Similarly, a second gusset 46 is formed along the second side 45 and extends inward toward the center of the sheet to a folded edge 48. When the tubular film F is opened to provide an interior space for a load, the folded edges 44, 48 of the gussets 42, 46 move away from one another so that the interior of the tubular film F may expand.

When the tubular film F lies flat, such as when it is removed from the roll of film R and before it is opened, the area of the sheet between the first side 41 of the sheet and the folded edge 44 of the first gusset 42 is stacked in four layers. Likewise, the area of the sheet between the second side 45 and the folded edge 48 of the second gusset is also stacked in four layers. On the other hand, each of the first and second gussets 42, 46 have a width that is less than half the width of the roll of film R, such that a gap exists between the folded edge 44 of the first gusset 42 and the folded edge 48 of the second gusset 46. Within the area of the gap between the folded edge 44 of the first gusset and the folded edge 48 of the second gusset 46, the flat tubular film F has two layers.

FIGS. 12 and 13 illustrate a sealing system 220 associated with the film supply assembly 200 of the stretch-hood machine 10. A roller 210 that is part of the film supply assembly directs the tubular film F to the sealing system 220 where the tubular film F is partially sealed to form a partly closed end of a section of tubular film. The stretch-hood machine may also include additional rollers to direct the tubular film F to other parts of the machine, such as the film-opening assembly. The sealing system 220 shown in FIGS. 12 and 13 includes a first sealing unit 230 and a second sealing unit 240 that are configured to receive the tubular film in a flat configuration and form a seal across a portion of the tubular film.

The first sealing unit 230 is positioned at the first side 41 of the tubular film F and the second sealing unit 240 is positioned at the second side 45 of the tubular film F. A gap 222 is provide between the first sealing unit 230 and the second sealing unit 240. Because there is a gap between the two sealing units 230, 240, when the tubular film F is sealed by the sealing system 220, an opening remains toward the center of the tubular film between two seal sections.

The first sealing unit 230 includes an elongated first sealing unit strip 232 and an elongated first auxiliary sealing unit strip 234. Each of the first sealing unit strip 232 and first auxiliary sealing unit strip 234 includes a heating element, such as a sealing wire that forms a seal in the tubular film F by heating layers of the tubular film such that the layers are joined together. The second sealing unit 240 similarly includes a second sealing unit strip 242 and a second auxiliary sealing unit strip 244. In other embodiments, the sealing units may include a single heating component. For example, in some embodiments, the first sealing unit may include a first sealing unit strip that includes a heating element and is able to form a seal without an auxiliary sealing unit strip.

FIG. 12 shows the sealing system 220 in a deactivated state such that the tubular film F can be moved through the sealing system 220 when a new section of tubular film is drawn from the roll of tubular film. FIG. 13 shows the sealing system 220 in an activated state for forming a seal in the tubular film F. In the illustrated embodiment, the sealing unit strips 232, 242 are physically separated from the auxiliary sealing unit strips 234, 244 when in the deactivated state. However, in some embodiments, the opposing strips of the sealing units may be configured to be activated and deactivated without moving the components of the sealing units. For example, the sealing units may have a gap that allows for the movement of the tubular film through the sealing units but is sufficiently narrow to seal the film when activated.

FIG. 14 shows a section of tubular film that has been partially sealed by the sealing system 220 at an upper end thereof. In particular, the first sealing unit 230 has formed a first seal section 52 on one side of the tubular film F and the second sealing unit 240 has formed a second seal section 54 on the other side of the tubular film F. An opening 56 is provided between the two seal sections 52, 54 and corresponds to the gap 222 in the sealing system 220. The section of tubular film F shown in FIG. 14 is reefed and arranged to be wrapped around the items that form the load L and the pallet P. For clarity, the stretch-hood machine is not shown in FIG. 14. As illustrated, the height of the load L is not consistent across the footprint of the load, and therefore a completely open top end of the section of tubular film may not be desirable for wrapping the load L. By partially sealing the section of tubular film F at the top end, the tubular film may have a higher likelihood of wrapping tightly around the load L to hold it in place. On the other hand, the opening 56 provided between the first seal section 52 and second seal section 54 allows access between the interior of the tubular film and the exterior environment when the section of tubular film is wrapped around the load L, which may help control moisture or other environmental conditions inside the tubular film.

As shown in FIGS. 12 and 13, the sealing system 220 is configured to form the seal sections to extend across the folded gussets formed in the sheet of tubular film. Specifically, the first sealing unit 230 is configured to cross the entire folded section of tubular film that forms the first gusset along the first side 41 of the tubular film F. The first sealing unit 230 extends from the edge along the first side 41 of the tubular film F inward past the inner folded edge 44 of the first gusset. Accordingly, when the seal is formed, all four layers within the first gusset are joined together. Likewise, the second sealing unit 240 is also configured to cross the entire folded section of the tubular film that forms the second gusset along the second side 45 of the tubular film F. The second sealing unit 240 extends from the edge along the second side 45 of the tubular film F inward past the inner folded edge 48 of the second gusset.

Furthermore, the sealing units 230, 240 in the illustrated embodiment extend inward past the inner folded edges of the sealing unit, so that the respective seal sections extend into a two-layer central section of the tubular film. The first sealing unit 230 extends inward past the inner folded edge 44 of the first gusset and the second sealing unit 240 extends inward past the inner folded edge 48 of the second gusset. Accordingly, part of the central section of the tubular film between the folded edges 44, 48, where the film has only two layers, is also sealed together.

In other embodiments, the sealing units may be configured to extend over different parts of the tubular film. For example, in some embodiments, the sealing units may be configured to only form seal sections within the area that forms the folded gussets. Further, in some embodiments, the sealing units may be configured to seal the tubular film only in the vicinity of the outer edges, such that the opening extends into the gussets. Moreover, in some embodiments, the sealing units may be configured to seal the tubular film in an area that is spaced from the outer edges, such that openings remain at the outer edges of the tubular film. Similarly, in some embodiments, the sealing system may include a single sealing unit, that is configured to extend across a central portion of the tubular film and leave openings in the film toward the edges.

Prior to removing the wrapped item from the stretch-hood machine, the section of tubular film that surrounds the load is cut from the roll of tubular film. In some embodiments, the tubular film is cut after it is drawn from the roll and before it is sealed. In other embodiments, the tubular film is sealed first and then is cut. Further, in some embodiments, the tubular film is cut and sealed at the same time. It is also possible that the tubular film be cut and/or sealed later in the wrapping process, such as after reefing or even after wrapping the load.

Figure 15:
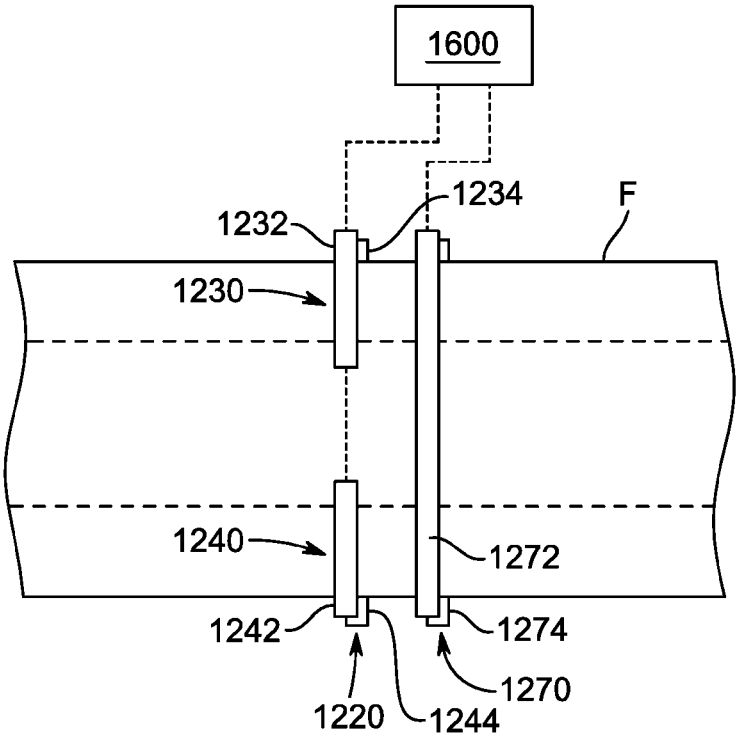
FIG. 15 is a schematic view of one example embodiment of a sealing system of the present disclosure.

FIGS. 15 to 18 illustrate various embodiments of sealing systems of a stretch-hood machine that allow for forming seals of different lengths across the tubular film. FIG. 15 shows an embodiment that includes a sealing system 1220 similar to that shown in FIGS. 12 and 13 that includes a first sealing unit 1230 and a second sealing unit 1240. Again, the first sealing unit 1230 is formed by a first sealing unit strip 1232 and a first auxiliary sealing unit strip 1234 on one side of the sheet of tubular film. The second sealing unit 1240 is formed by a second sealing unit strip 1242 and a second auxiliary sealing unit strip 1244 on the opposing side of the sheet of tubular film. The sealing system 1220 is operably connected to the controller 1600 of the stretch-hood machine such that the controller 1600 may activate the sealing units 1230, 1240 to form a partial seal across the sheet of tubular film F. As explained further above, the sealing units 1230, 1240 may be activated and deactivated by physically moving the sealing unit strips toward and away from the film, by energizing or disconnecting the sealing unit strips, or both.

The configuration in FIG. 15 also includes an additional sealing system formed by a continuous sealing unit 1270 that extends across the entire width of the strip of tubular film F. The continuous sealing unit 1270 includes a continuous sealing unit strip 1272 and an auxiliary continuous sealing unit strip 1274 that cooperate to form a seal that extends across the width of the tubular film F. The continuous sealing unit 1270 is operably connected to the controller 1600 of the stretch-hood machine such that the controller 1600 may activate the continuous sealing unit 1270 to form a full seal across the tubular film.

With the configuration shown in FIG. 15, the controller 1600 can select whether to form a full seal by activating the continuous sealing unit 1270, a partial seal by activating first sealing unit 1230 and second sealing unit 1240, or no seal across the upper end of the section of tubular film. For example, the controller 1600 may choose the type of seal to form across the tubular film based on an input from a user, based on stored data associated with the load being wrapped, or based on readable information provided on the load being wrapped, for example.

Figure 16:
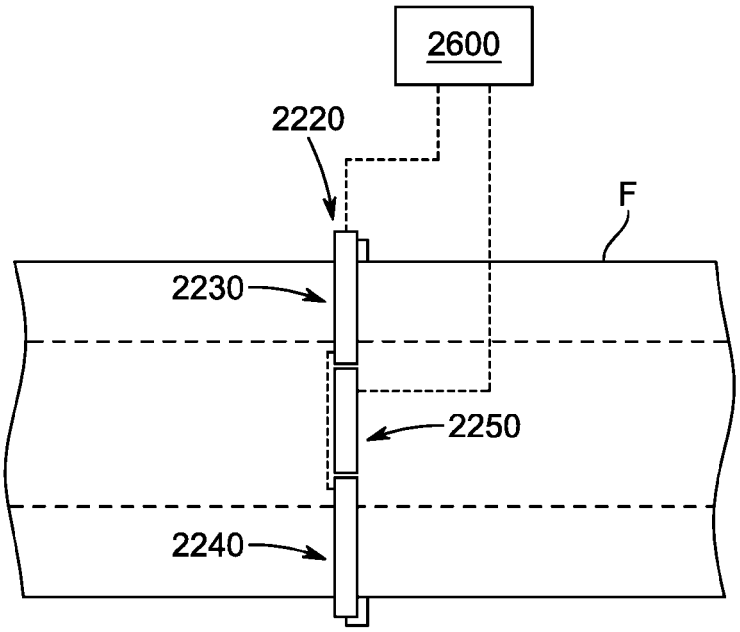
FIG. 16 is a schematic view of another example embodiment of a sealing system of the present disclosure.

FIG. 16 shows an embodiment that includes a sealing system 2220 that includes a first sealing unit 2230 and a second sealing unit 2240, similar to that of FIGS. 12, 13 and 15, as well as a third sealing unit 2250. The first sealing unit 2230 and second sealing unit 2240 are jointly coupled to controller 2600 and are configured to be collectively activated. In contrast, the third sealing unit 2250 is independently coupled to controller 2600. This configuration allows the controller to select whether to form a full seal across the tubular film, by activating the first sealing unit 2230, the second sealing unit 2240, and the third sealing unit 2250, or to form a partial seal by activating only the first sealing unit 2230 and second sealing unit 2240. Again, as stated above, the sealing units 2230, 2240, 2250 may be activated and deactivated by physically moving the sealing unit strips toward and away from the film, by energizing or disconnecting the sealing unit strips, or both.

In the depicted embodiment, the third sealing unit 2250 is arranged in a line with the first sealing unit 2230 and the second sealing unit 2240. Moreover, the illustrated third sealing unit 2250 is configured to be activated concurrently with the first sealing unit 2230 and second sealing unit 2250. In other embodiments, the third sealing unit may be located at a different location and be configured to seal the gap formed between the seal sections provided by the first sealing unit and second sealing at a different time. For example, the stretch-hood machine may be configured to move the film to the third sealing unit after the first and second seal sections are formed.

Figure 17:
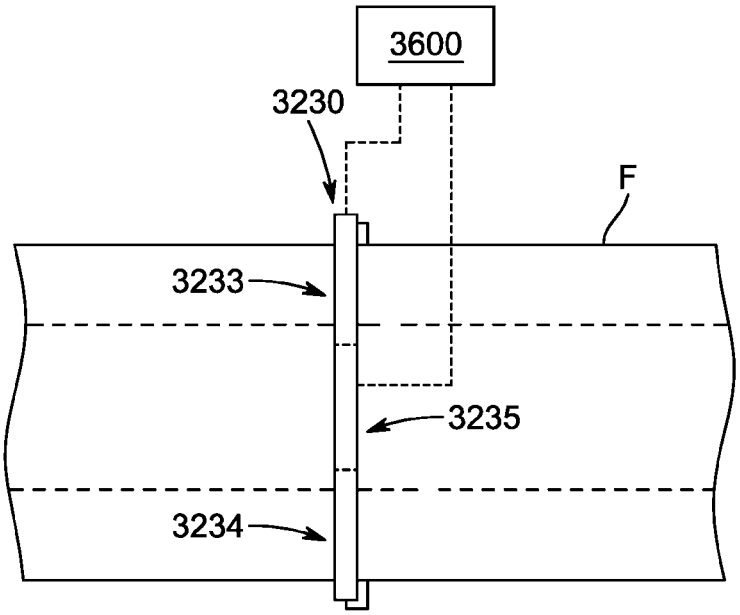
FIG. 17 is a schematic view of another example embodiment of a sealing system of the present disclosure.

FIG. 17 shows an embodiment similar to that of FIG. 16 but including a single sealing unit 3230 with sections that may be activated independently. Specifically, sealing unit 3230 includes a first sealing section 3233, a second sealing section 3234, and a third sealing section 3235. The first and second sealing sections 3233, 3234 are positioned at the ends of the sealing unit 3230, while the third sealing section 3235 is positioned toward the middle. Accordingly the controller 3600 may activate the different sections to selectively create a partial or full seal across the tubular film. For example, by activating the first sealing section 3233 and second sealing section 3234, the controller 3600 may control the sealing unit 3230 to form a partial seal with an opening toward the center. Alternatively, the controller 3600 may activate only the third sealing section 3235 to form a partial seal toward the middle of the tubular film. Further still, the controller 3600 can activate the entire sealing unit 3230, including the first sealing section 3233, second sealing section 3234 and third sealing section 3235 to form a seal across the entirety of the tubular film.

Figure 18:
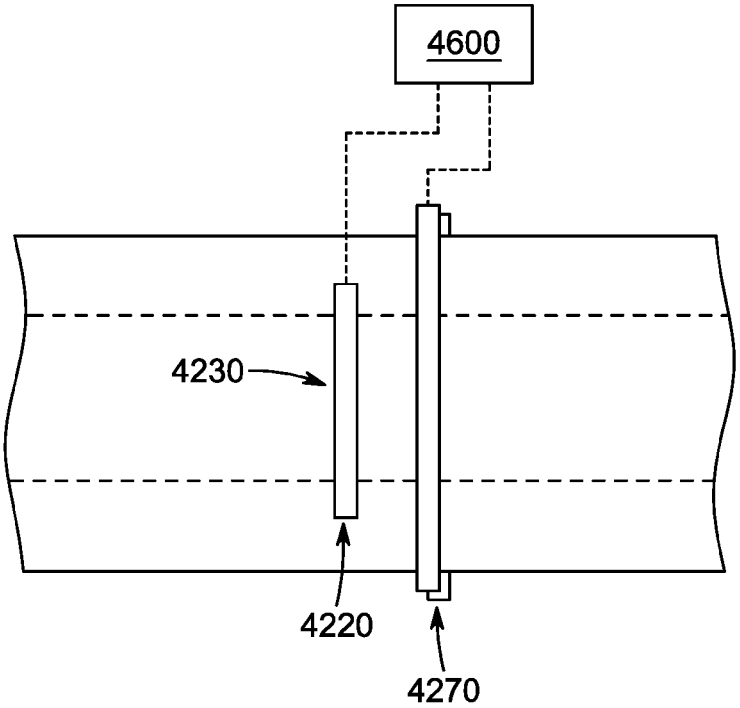
FIG. 18 is a schematic view of another example embodiment of a sealing system of the present disclosure.

FIG. 18 illustrates another embodiment of a sealing system 4220 that includes a first sealing unit 4230. Unlike the previously described embodiments, first sealing unit 4230 extends across the center of the tubular film and is configured to form a seal across the entire central section between the gussets. However first sealing unit 4230 has a length that is shorter than the width of the sheet of tubular film, and thus is configured to leave unsealed sections at the outer edges of the tubular film. Accordingly, first sealing unit 4230 will form four openings at the outer corners of the tubular film.

The first sealing unit 4230 is operatively connected to the controller 4600. Further, the system shown in FIG. 18 also includes another sealing system including a continuous sealing unit 4270 that is also operatively connected to the controller 4600. Accordingly, the controller 4600 can select whether to form a partial seal by activating first sealing unit 4230 or a full seal by activating the continuous sealing unit 4270.

While the sealing units described above are configured to form an entire seal section at one time, in other embodiments, the methods described herein may be performed using a sealing device that forms a seal while travelling across the tubular film, such as a rolling sealing unit, a laser, or another moving sealing configuration.

The disclosure also provides a method of performing a series of wrapping operations for wrapping items with different seal configurations. For example, in a series of wrapping operations a first wrapping operation includes: receiving a first item in a stretch-hood machine; drawing a first section of tubular film from a roll of film; forming a first seal section at a first end of the first section of tubular film, wherein the first seal section extends across only a portion of a width of the tubular film so as to provide a partial seal with a first opening at the first end of the first section of tubular film; positioning the first section of tubular film on a plurality of reefing devices; reefing the first section of tubular film onto reefing fingers of the plurality of reefing devices; lowering the reefing devices around the first item to wrap the first item within an interior of the tubular film, wherein the first opening at the first end of the first section of tubular film provides access between the interior of the tubular film and the exterior environment; and removing the wrapped first item from the stretch-hood machine.

A second wrapping operation in the series of wrapping operations includes: receiving a second item in the stretch-hood machine; drawing a second section of tubular film from a roll of film; forming a full seal at a first end of the second section of tubular film; positioning the second section of tubular film on the plurality of reefing devices; reefing the second section of tubular film onto the reefing fingers of the plurality of reefing devices; lowering the reefing devices around the second item to wrap the second item within an interior of the tubular film; and removing the wrapped second item from the stretch-hood machine.

The forming of the first seal section in the first wrapping operation may be carried out according to any of the above-described methods using any of the described sealing systems.

In some embodiments, the series of wrapping operations includes a third wrapping operation that includes: receiving a third item in the stretch-hood machine; drawing a third section of tubular film from a roll of film; positioning the third section of tubular film on the plurality of reefing devices; reefing the third section of tubular film onto the reefing fingers of the plurality of reefing devices; lowering the reefing devices around the third item to wrap the third item within an interior of the tubular film and with an upper end of the third section of tubular film unsealed; and removing the wrapped third item from the stretch-hood machine.

Thus, in various embodiments, the present disclosure provides a method of operating a stretch-hood machine to wrap an item with a section of tubular film. The method includes drawing a section of tubular film from a roll of film and forming a first seal section at a first end of the section of tubular film. The first seal section extends across only a portion of a width of the tubular film so as to provide a partial seal with a first opening at the first end of the section of tubular film. The method also includes positioning the section of tubular film on a plurality of reefing devices and reefing the section of tubular film onto reefing fingers of the reefing devices. Further, the method includes lowering the reefing devices around the item to wrap the item within an interior of the tubular film. The first opening at the first end of the section of tubular film provides access between the interior of the tubular film and the exterior environment.

In various such embodiments of the method, the method further comprises forming a second seal section at the first end of the section of tubular film that is from the first seal section by a gap so as to form the opening between the first seal section and the second seal section.

In various such embodiments of the method, a first part of the tubular film is folded to form a first gusset along a first side of the tubular film, and wherein at least a portion of the first seal section joins four layers of the tubular film formed by the first gusset.

In various such embodiments of the method, the first seal section extends across the entire folded first part of the tubular film from an outer edge of the tubular film to an inner folded edge of the first gusset.

In various such embodiments of the method, another portion of the first seal section extends inward from the first gusset and joins two opposing layers of tubular film.

In various such embodiments of the method, the method further comprises separating the section of tubular film from the roll of film after forming the first seal section at the first end of the section of tubular film.

In various such embodiments of the method, the first seal section is formed by a sealing system including a first sealing unit strip.

In various such embodiments of the method, the first sealing unit strip includes a heating element.

In various such embodiments of the method, the first sealing unit strip has a length that is smaller than a width of the roll of film.

In various other embodiments, the disclosure further provides a stretch-hood machine including a machine frame, a wrapping carriage movable relative to the machine frame between upper and lower positions, and a plurality of reefing devices supported by the wrapping-carriage and configured to wrap a section of tubular film around an item. A film-supply assembly is configured to direct the section of tubular film to the reefing devices from a roll of tubular film having a first width. The stretch-hood machine further includes a sealing system comprising a first sealing unit strip having a length that is smaller than the first width of the roll of tubular film and configured to form a first seal section at a first end of the section of tubular film that extends across only a portion of the width of the tubular film so as to provide a partial seal with a first opening at the first end of the section of tubular film.

In various such embodiments of the stretch-hood machine, the sealing system includes a second sealing unit strip arranged to be in line with the first sealing unit strip and spaced apart from the first sealing unit strip by a gap.

In various other embodiments, the disclosure further provides a stretch-hood machine including a machine frame, a wrapping carriage movable relative to the machine frame between upper and lower positions, and a plurality of reefing devices supported by the wrapping-carriage and configured to wrap a section of tubular film around an item. A film-supply assembly is configured to direct the section of tubular film to the reefing devices from a roll of tubular film having a first width. The machine also includes a sealing system including first and second sealing unit strips that extend along a first line and are spaced apart along the first line by a gap and are configured to provide a partial seal with an opening corresponding to the gap between the first and second sealing unit strips.

In various such embodiments of the stretch-hood machine, the stretch-hood machine further comprises an additional sealing system including a continuous sealing unit strip having a length that is greater than the combined length of the first and second sealing unit strips and is configured to form a seal section that extends across an entire width of the tubular film.

In various such embodiments of the stretch-hood machine, the stretch-hood machine further comprises a controller configured to selectively activate: the first and second sealing unit strips so as to form a partial seal across the tubular film with an opening therein, or the continuous sealing unit strip so as to form a seal that extends across the entire width of the tubular film.

In various such embodiments of the stretch-hood machine, the sealing system includes a third sealing unit strip arranged in line between the first sealing unit strip and second sealing unit strip.

In various such embodiments of the stretch-hood machine, the stretch-hood machine further comprises a controller configured to selectively activate: the first and second sealing unit strips so as to form a partial seal across the tubular film with an opening therein, or the first, second, and third sealing unit strips so as to form a seal that extends across the entire width of the tubular film.

Various changes and modifications to the above-described embodiments described herein will be apparent to those skilled in the art. These changes and modifications can be made without departing from the spirit and scope of this present subject matter and without diminishing its intended advantages. Not all of the depicted components described in this disclosure may be required, and some implementations may include additional, different, or fewer components from those expressly described in this disclosure. Variations in the arrangement and type of the components; the shapes, sizes, and materials of the components; and the manners of attachment and connections of the components may be made without departing from the spirit or scope of the claims as set forth herein. Also, unless otherwise indicated, any directions referred to herein reflect the orientations of the components shown in the corresponding drawings and do not limit the scope of the present disclosure. This specification is intended to be taken as a whole and interpreted in accordance with the principles of the invention as taught herein and understood by one of ordinary skill in the art.

The invention claimed is:

1. A method of operating a stretch-hood machine to wrap an item with a tubular film, the method comprising:

drawing the tubular film from a roll of film;

forming a first seal section at a first end of a section of the tubular film, wherein the first seal section extends across only a portion of a width of the tubular film so as to provide a partial seal with a first opening at the first end of the section of the tubular film;

positioning the tubular film on a plurality of reefing devices;

reefing the tubular film onto reefing fingers of the reefing devices; and lowering the reefing devices around the item to wrap the item within an interior of the tubular film, wherein the first opening at the first end of the section of the tubular film provides access between the interior of the tubular film and an exterior environment.

2. The method of claim 1, further comprising forming a second seal section at the first end of the section of the tubular film that is spaced apart from the first seal section by a gap so as to form the first opening between the first seal section and the second seal section.

3. The method of claim 1, wherein a first part of the tubular film is folded to form a first gusset along a first side of the tubular film, and wherein at least a portion of the first seal section joins four layers of the tubular film formed by the first gusset.

4. The method of claim 3, wherein the first seal section extends across the entire folded first part of the tubular film from an outer edge of the tubular film to an inner folded edge of the first gusset.

5. The method of claim 3, wherein another portion of the first seal section extends inward from the first gusset and joins two opposing layers of the tubular film.

6. The method of claim 1, further comprising separating the section of the tubular film from the roll of film after forming the first seal section at the first end of the section of the tubular film.

7. The method of claim 1, wherein the first seal section is formed by a sealing system including a first sealing unit strip.

8. The method of claim 7, wherein the first sealing unit strip includes a heating element.

9. The method of claim 7, wherein the first sealing unit strip has a length that is smaller than a width of the roll of film.

10. A stretch-hood machine comprising:

a machine frame;

a wrapping carriage movable relative to the machine frame between upper and lower positions;

a plurality of reefing devices supported by the wrapping carriage and configured to wrap tubular film around an item;

a film-supply assembly configured to direct the tubular film to the reefing devices from a roll of tubular film having a first width; and a sealing system comprising a first sealing unit strip having a length that is smaller than the first width of the roll of tubular film and configured to form a first seal section at a first end of a section of the tubular film that extends across only a portion of a width of the tubular film so as to provide a partial seal with a first opening at the first end of the section of the tubular film.

11. The stretch-hood machine of claim 10, wherein the sealing system includes a second sealing unit strip arranged to be in line with the first sealing unit strip and spaced apart from the first sealing unit strip by a gap.

12. The stretch-hood machine of claim 11, further comprising an additional sealing system including a continuous sealing unit strip having a length that is greater than a combined length of the first and second sealing unit strips and configured to form a seal section that extends across an entirety of the width of the tubular film.

13. The stretch-hood machine of claim 12, further comprising a controller configured to selectively activate:

the first and second sealing unit strips so as to form a partial seal across the tubular film with an opening therein, or the continuous sealing unit strip so as to form a seal that extends across the entirety of the width of the tubular film.

14. The stretch-hood machine of claim 11, wherein the sealing system includes a third sealing unit strip arranged in line between the first sealing unit strip and the second sealing unit strip.

15. The stretch-hood machine of claim 14, further comprising a controller configured to selectively activate:

the first and second sealing unit strips so as to form a partial seal across the tubular film with an opening therein, or the first, second, and third sealing unit strips so as to form a seal that extends across an entirety of the width of the tubular film.

16. A stretch-hood machine comprising:

a machine frame;

a wrapping carriage movable relative to the machine frame between upper and lower positions;

a plurality of reefing devices supported by the wrapping carriage and configured to wrap tubular film around an item;

a film-supply assembly configured to direct the tubular film to the reefing devices from a roll of tubular film having a first width; and a sealing system comprising first and second sealing unit strips that extend along a first line, are spaced apart along the first line by a gap, and are configured to provide a partial seal on the tubular film with an opening corresponding to the gap between the first and second sealing unit strips.

17. The stretch-hood machine of claim 16, further comprising an additional sealing system including a continuous sealing unit strip having a length that is greater than a combined length of the first and second sealing unit strips and configured to form a seal section that extends across an entire width of the tubular film.

18. The stretch-hood machine of claim 17, further comprising a controller configured to selectively activate:

the first and second sealing unit strips so as to form a partial seal across the tubular film with an opening therein, or the continuous sealing unit strip so as to form a seal that extends across the entire width of the tubular film.

19. The stretch-hood machine of claim 16, wherein the sealing system includes a third sealing unit strip arranged in line between the first sealing unit strip and the second sealing unit strip.

20. The stretch-hood machine of claim 19, further comprising a controller configured to selectively activate:

the first and second sealing unit strips so as to form a partial seal across the tubular film with an opening therein, or the first, second, and third sealing unit strips so as to form a seal that extends across an entire width of the tubular film.

* * * * *